US006373065B1

(12) United States Patent
Francke et al.

(10) Patent No.: US 6,373,065 B1
(45) Date of Patent: Apr. 16, 2002

(54) RADIATION DETECTOR AND AN APPARATUS FOR USE IN PLANAR BEAM RADIOGRAPHY

(75) Inventors: Tom Francke, Sollentuna; Vladimir Peskov, Stockholm; Christer Ullberg, Sollentuna, all of (SE)

(73) Assignee: DigiRay AB, Danderyd (SE)

( * ) Notice: Subject to any disclaimer, the term of this patent is extended or adjusted under 35 U.S.C. 154(b) by 0 days.

(21) Appl. No.: 09/443,292

(22) Filed: Nov. 19, 1999

(30) Foreign Application Priority Data

Apr. 14, 1999 (SE) ..... 9901324

(51) Int. Cl.[7] ..... H01J 47/08
(52) U.S. Cl. ..... 250/374; 250/385.1
(58) Field of Search ..... 250/347, 385.1

(56) References Cited

U.S. PATENT DOCUMENTS 5,347,131 A * 9/1994 Charpak ..... 250/385.1
5,959,302 A * 9/1999 Charpak ..... 250/385.1
6,118,125 A * 9/2000 Carlson et al. ..... 250/385.1

FOREIGN PATENT DOCUMENTS

WO 9923859 5/1999

OTHER PUBLICATIONS

Nucl. Instrum. Methods Phys. Res., Sect. A (1994),348(2–3), 351–5 CODEN: NIMAER; ISSN: 0168–9002.*

* cited by examiner

*Primary Examiner*—Scott J. Sugarman
*Assistant Examiner*—Mohammed Hasan
(74) *Attorney, Agent, or Firm*—Birch, Stewart, Kolasch, & Birch, LLP

(57) ABSTRACT

A detector (64) for detection of ionizing radiation, and an apparatus for use in planar beam radiography, including the detector (64). The detector (64) includes a chamber filled with an ionizable gas; first and second electrode arrangements (2, 1, 18, 19) provided in the chamber with a space between them, the space including a conversion volume (13); an electron avalanche amplification unit (17) arranged in the chamber; and, at least one arrangement of read-out elements (15) for detecting of electron avalanches. A radiation entrance is provided so that radiation enters the conversion volume between the first and second electrode arrangements. In order to achieve detectors which are simple to stack with each other, the first and second electrode arrangements exhibit a first and a second main plane, said planes being non-parallel. This permits stacked detectors to be manufactured simply and cost effectively.

30 Claims, 6 Drawing Sheets

RADIATION DETECTOR AND AN APPARATUS FOR USE IN PLANAR BEAM RADIOGRAPHY

FIELD OF THE INVENTION

The invention relates to a detector for detection of ionizing radiation, and to an apparatus for use in planar beam radiography.

BACKGROUND OF THE INVENTION AND RELATED ART

A detector and an apparatus of the kind mentioned above are described in the copending U.S. application Ser. No. 08/969,554 and the copending SE applications SE 9901326-0, SE 9901327-8, SE 9901325-2 and SE 9901562-0, which are incorporated herein by reference. The detector described therein includes a gaseous parallel plate avalanche chamber. The detector provides good resolution, high X-ray detection efficiency, and possibility to count every photon incident in the detector. This provides a huge number of possibilities when processing the detection signals, such as energy detection, discriminating detection signals from photons in certain energy ranges or from photons incident at certain distance ranges from the anode or the cathode.

When using a detector of this kind in planar beam X-ray radiography, e.g. slit or scan radiography, an apparatus which provides that an object to be imaged only needs to be irradiated with a low dose of X-ray photons is achieved, while an image of high quality is obtained.

For gaseous parallel plate avalanche chamber it has been regarded as necessary that the anode and cathode plates are parallel, and much effort has been made to achieve high parallelism between the plates. Such a detector is a one-dimensional detector, and to obtain a two-dimensional image the second dimension for the image can be achieved by scanning the X-ray beam and detector across the object to be imaged. To ease the X-ray tube loading and simplify the mechanics (by reducing the scanning distance), a multiline set of one-dimensional detectors is beneficial. This also shortens the scanning time.

For such a multiline detector a number of one-dimensional detectors can be stacked. In such a case it is desirable that the detectors are aligned with the X-ray source. When the plates of the detector are parallel, the assembling and alignment of a detector unit, comprised of a plurality of one-dimensional detectors, is complicated and time-consuming.

SUMMARY OF THE INVENTION

The present invention is directed to a one-dimensional detector for detection of ionizing radiation, which employs avalanche amplification, and can be stacked with other one-dimensional detectors to form a detector unit in a simple and cost effective way.

This and other objects are attained by a detector for detection of ionizing radiation, comprising a chamber filled with an ionizable gas, first and second electrode arrangements provided in said chamber with a space between them, said space including a conversion volume, and an electron avalanche amplification unit arranged in said chamber, and wherein the first and second electrode arrangements exhibit a first and a second main plane, said planes being non-parallel, said electron avalanche amplification unit including at least one avalanche cathode arrangement and at least one avalanche anode arrangement, wherein an electric field for avalanche amplification is created between said at least one avalanche cathode arrangement and said at least one avalanche anode arrangement. The above detector provides good resolution, high X-ray detection efficiency, and the ability to count every photon incident in the detector.

The above detector also provides good energy resolution for X-rays.

The above detector also can operate at high X-ray fluxes without performance degradation and has a long lifetime.

The above detector also provides effective detection of any kind of radiation, including electromagnetic radiation as well as incident particles, including elementary particles.

The present invention is also directed to an apparatus for use in planar beam radiography, comprising at least one one-dimensional detector for detection of ionizing radiation, which employs avalanche amplification, and can be stacked with other one-dimensional detectors to form a detector unit in a simple and cost effective way.

This and other objects are attained by an apparatus for use in planar beam radiography, comprising an X-ray source, a substantially planar beam unit for forming a substantially planar X-ray beam positioned between said X-ray source and an object to be imaged, a chamber filled with an ionizable gas, first and second electrode arrangements provided in said chamber with a space between them, said space including a conversion volume, and an electron avalanche amplification unit arranged in said chamber, and wherein the first and second electrode arrangements exhibit a first and a second main plane, said planes being non-parallel, said electron avalanche amplification unit including at least one avalanche cathode arrangement and at least one avalanche anode arrangement, wherein an electric field for avalanche amplification is created between said at least one avalanche cathode arrangement and said at least one avalanche anode arrangement.

The above apparatus can also be used in planar beam radiography, e.g. slit or scan radiography,where the object to be imaged only needs to be irradiated with a low dose of X-ray photons, but an image of high quality is still obtained.

The above apparatus also can be used in planar beam radiography, in which a major fraction of the X-ray photons incident on the detector can be detected, for further counting or integration in order to achieve a value for each pixel of the image.

The above apparatus can also be used in planar beam radiography, in which image noise caused by radiation scattered in an object to be examined is strongly reduced.

The above apparatus can also be used in planar beam radiography, in which image noise caused by the spread of X-ray energy spectrum is reduced.

The above apparatus can also be used in planar beam radiography, including the simple and inexpensive detector that can operate with high X-ray detection efficiency and with good energy resolution for X-rays.

The above apparatus can also be used in planar beam radiography, including the detector which can operate at high X-ray fluxes without a performance degradation and has a long lifetime.

DESCRIPTION OF PREFERRED EMBODIMENTS

Figure 1:
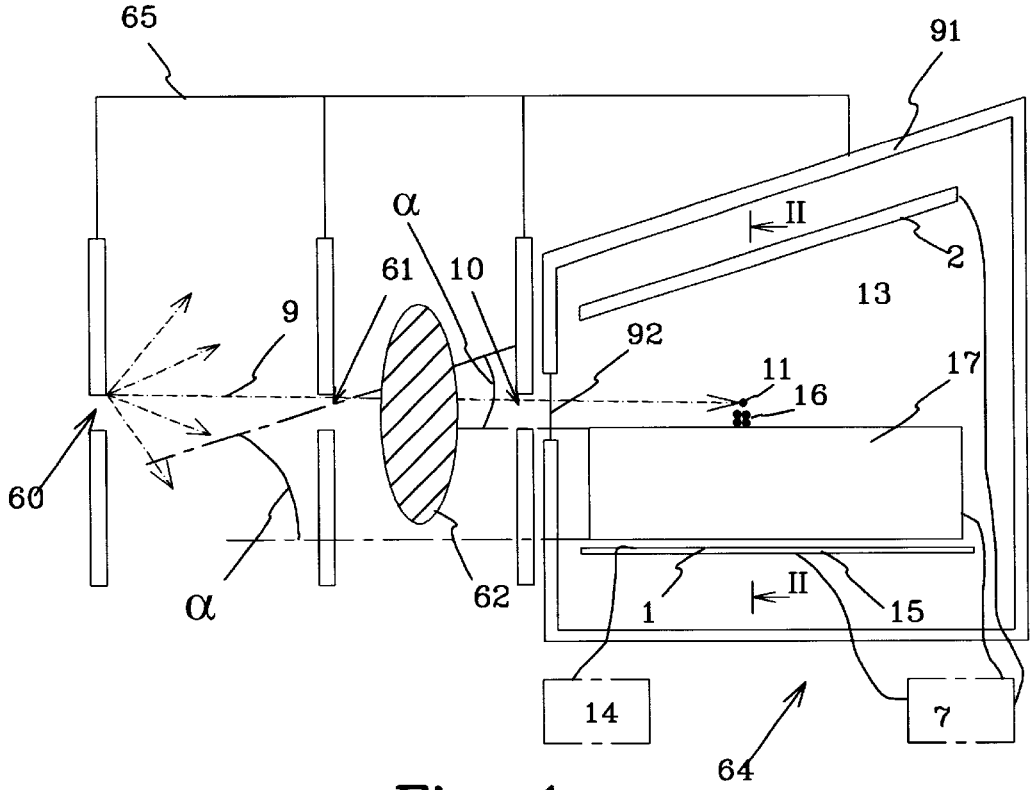
FIG. 1 illustrates schematically, in an overall view, an apparatus for planar beam radiography, according to a general embodiment of the invention.

FIG. 1 is a sectional view in a plane orthogonal to the plane of a planar X-ray beam 9 of an apparatus for planar beam radiography, according to the invention. The apparatus includes an X-ray source 60, which together with a first thin collimator window 61 produces a planar fan-shaped X-ray beam 9, for irradiation of an object 62 to be imaged. The first thin collimator window 61 can be replaced by other means for forming an essentially planar X-ray beam, such as an X-ray diffraction mirror or an X-ray lens etc. The beam transmitted through the object 62 enters a detector 64. Optionally a thin slit or second collimator window 10, which is aligned with the X-ray beam forms the entrance for the X-ray beam 9 to the detector 64. A major fraction of the incident X-ray photons are detected in the detector 64, which includes a conversion and drift volume 13, and an electron avalanche amplification unit 17, and is oriented so that the X-ray photons enter sideways between two electrode arrangements 1, 2, between which an electric field for drift of electrons and ions in the conversion and drift volume 13 is created. Collimator 61 collimates the planar X-ray beam.

The detector 64 and its operation will be further described below. The X-ray source 60, the first thin collimator window 61, the optional collimator window 10 and the detector 64 are connected and fixed in relation to each other by for example a frame or support 65. The so formed apparatus for radiography can be moved as a unit to scan an object, which is to be examined. In a single detector system, as shown in FIG. 1, scanning is achieved by a pivoting movement, rotating the unit around an axis through for example the X-ray source 60 or the detector 64. The location of the axis depends on the application or use of the apparatus, and possibly the axis can also run through the object 62, in some applications. Scanning can also be achieved by a translative movement where the detector and the collimator are moved, or the object to be imaged is moved. In a multiline configuration, where a number of detectors are stacked, as will be explained later, in connection with FIGS. 5 and 6, the scanning can be done in various ways. In many cases it may be advantageous if the apparatus for radiography is fixed and the object to be imaged is moved.

The detector 64 includes a first drift electrode arrangement being a cathode plate 2 and a second drift electrode arrangement being an anode plate 1. As seen they are arranged with an angle $\alpha$ with respect to each other, in a plane perpendicular to the planar X-ray beam. The space in between includes a thin gas-filled gap or region 13, termed a conversion and drift volume, and an electron avalanche amplification unit 17. A voltage is applied between the anode plate 1 and the cathode plate 2, and one or several voltages is (are) applied to the electron avalanche amplification unit 17. This results in a drift field causing drift of electrons and ions in the gap 13, and an electron avalanche amplification field or electron avalanche amplification fields in the electron avalanche amplification unit 17. In connection with the anode plate 1 is an arrangement 15 of read-out elements for detection of electron avalanches provided. Preferably the arrangement of read-out elements 15 also constitutes the anode electrode. Alternatively the arrangement of read-out elements 15 can be formed in connection with the cathode plate 2 or the electron avalanche amplification unit 17. The arrangement 15 of read-out elements can also be formed on the anode or cathode plate separated from the anode or cathode electrode by a dielectric layer or substrate. In this case it is necessary that the anode or cathode electrode is semi-transparent to induced pulses, e.g. formed as strips or pads. In connection with FIGS. 3 and 4 below different possible arrangements 15 of read-out elements are shown.

As seen, the X-rays to be detected are incident sideways on the detector and enters the conversion and drift volume 13 between the cathode plate 2 and the anode plate 1. The X-rays enter the detector preferably in a direction parallel to the anode plate 1, and may enter the detector through a thin slit or collimator window 10. In this way the detector can easily be made with an interaction path long enough to allow a major fraction of the incident X-ray photons to interact and be detected. In the case a collimator is used, this should preferably be arranged so that the thin planar beam enters the detector close to the electron avalanche amplification unit 17 and preferably parallel therewith.

The gap or region 13 is filled with a gas, which can be a mixture of for example 90% krypton and 10% carbon dioxide or a mixture of for example 80% xenon and 20% carbon dioxide. The gas can be under pressure, preferably in a range 1–20 atm. Therefore, the detector includes a gas tight housing 91 with a slit entrance window 92, through which the X-ray beam 9 enters the detector. The window is made of a material, which is transparent for the radiation, e.g. Mylar®, or a thin aluminum foil. This is a particularly advantageous additional effect of the invention, detecting sideways incident beams in a gaseous avalanche chamber 64, compared to previously used gaseous avalanche chambers, which were designed for radiation incident perpendicular to the anode and cathode plates, requiring a window covering a large area. The window can in this way be made thinner, thus reducing the number of X-ray photons absorbed in the window.

In operation, the incident X-rays 9 enter the detector through the optional thin slit or collimator window 10, if present, close to the electron avalanche amplification unit 17, and travel through the gas volume in a direction preferably parallel with the electron avalanche amplification unit 17. Each X-ray photon produces a primary ionization electron-ion pair within the gas as a result of interaction with a gas atom. This production is caused by photoeffect, Compton-effect or Auger-effect. Each primary electron 11 produced looses its kinetic energy through interactions with new gas atoms, causing further production of electron-ion pairs (secondary ionization electron-ion pairs). Typically between a few hundred and thousand secondary ionization electron-ion pairs are produced from a 20 keV X-ray photon in this process. The secondary ionization electrons 16 (together with the primary ionization electron 11) will drift towards the electron avalanche amplification unit 17 due to the electric field in the conversion and drift volume 13. When the electrons enter the strong electric field, or regions of focused field lines of the electron avalanche amplification unit 17 they will undergo avalanche amplification, which will be described further below.

The movements of the avalanche electrons and ions induce electrical signals in the arrangement 15 of read-out elements for detection of electron avalanches. Those signals are picked up in connection with the electron avalanche amplification unit 17, the cathode plate 2 or the anode plate 1, or a combination of two or more of said locations. The signals are further amplified and processed by readout circuitry 14 to obtain accurate measurements of the X-ray photon interaction points, and optionally the X-ray photon energies.

Figure 2A:
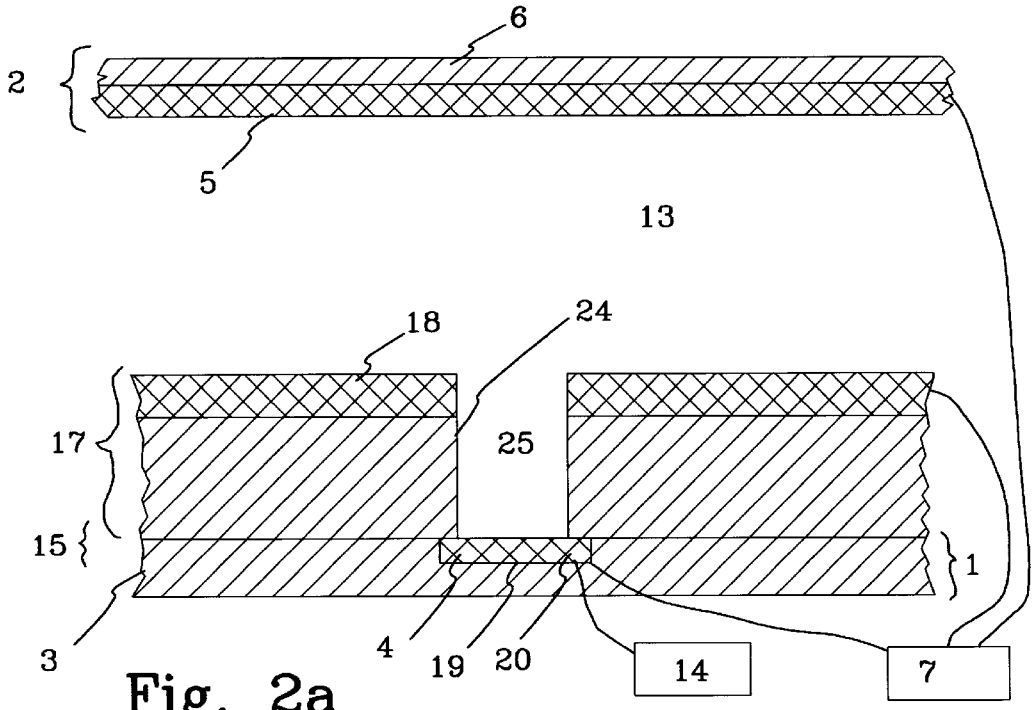
FIG. 2*a* is a schematic, partly enlarged, cross sectional view, taken at II—II in FIG. 1, of a detector according to a first specific embodiment of the invention.

FIG. 2*a* shows a schematic, partly enlarged, cross sectional view, taken at II—II in FIG. 1, of a detector according to a first specific embodiment of the invention. As seen, the cathode plate 2 comprises a dielectric substrate 6 and a conductive layer 5 being a cathode electrode. The anode 1 comprises a dielectric substrate 3 and a conductive layer 4 being an anode electrode. Between the gap 13 and the anode 1 an electron avalanche amplification unit 17 is arranged. This amplification unit 17 includes an avalanche amplification cathode 18 and an avalanche amplification anode 19, separated by a dielectric 24. This could be a gas or a solid substrate 24 carrying the cathode 18 and the anode 19, as shown in the figure. As seen, the anode electrodes 4 and 19 are formed by the same conductive element. Between the cathode 18 and the anode 19 a voltage is applied by means of a DC power supply 7 for creation of a very strong electric field in an avalanche amplification region 25. The avalanche region 25 is formed in a region between and around the edges of the avalanche cathode 18 which are facing each other, where a concentrated electric field will occur due to the applied voltages. The DC power supply 7 is also connected with the cathode electrode 5 and the anode electrode 4 (19). The voltages applied are selected so that a weaker electric field, drift field, is created over the gap 13. Electrons (primary and secondary electrons) released by interaction in the conversion and drift volume 13 will drift, due to the drift field, towards the amplification unit 17. They will enter the very strong avalanche amplification fields and be accelerated. The accelerated electrons 11, 16 will interact with other gas atoms in the region 25 causing further electron-ion pairs to be produced. Those produced electrons will also be accelerated in the field, and will interact with new gas atoms, causing further electron-ion pairs to be produced. This process continues during the travel of the electrons in the avalanche region towards the anode 19 and an electron avalanche is formed. After leaving the avalanche region the electrons will drift towards the anode 19. The electron avalanche may continue up to the anode 19 if the electric field is strong enough.

The avalanche region 25 is formed by an opening or channel in the cathode 18 and the dielectric substrate 24, if present. The opening or channel can be circular, seen from above, or continuous, longitudinal extending between two edges of the substrate 24, if present, and the cathode 18. In the case the openings or channels are circular when seen from above they are arranged in rows, each row of openings or channels including a plurality of circular openings or channels. A plurality of longitudinal openings or channels or rows of circular channels are formed beside each other, parallel with each other or with the incident X-rays. Alternatively, the circular openings or channels can be arranged in other patterns.

The anode electrodes 4, 19 also forms readout elements 20 in the form of strips provided in connection with the openings or channels forming the avalanche regions 25. Preferably one strip is arranged for each opening or channel or row of openings or channels. The strips could be divided into sections along its length, where one section could be provided for each circular opening or channel or for a plurality of openings or channels, in the form of pads. The strips and the sections, if present, are electrically insulated from each other. Each detector electrode element i.e. strip or section is preferably separately connected to processing electronics 14. Alternatively the read-out elements can be located on the back side of the substrate (opposite the side of the anode electrodes 4, 19). In this case it is necessary that the anode electrodes 4, 19 are semi-transparent to induced pulses, e.g. in the form of strips or pads. In connection with FIGS. 3 and 4 below different possible arrangements 15 of read-out elements are shown.

As an example the longitudinal channels can have a width in the range 0.01–1 mm, the circular channels can have a diameter of the circle in the range 0.01–1 mm, and the thickness of the dielectric 24 (separation between the avalanche cathode 18 and anode 19) is in the range 0.01–1 mm.

Alternatively the conductive layers 5, 4 can be replaced by a resistive carrier of e.g. silicon monoxide, conductive glass or diamond, with the dielectric substrates 3, 6 replaced by a conductive layer. In such a case a dielectric layer or carrier is preferably arranged between the conductive layer and the readout elements 20 when they are located in connection with a drift electrode arrangement.

Figure 2B:
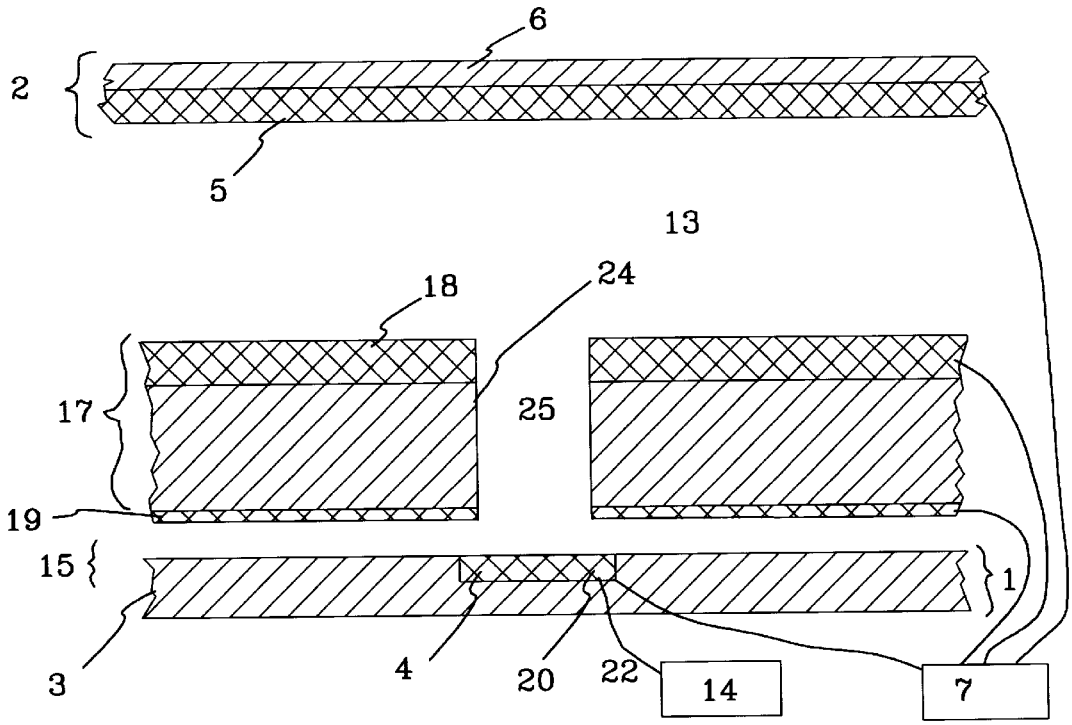
FIG. 2*b* is a schematic, partly enlarged, cross sectional view, taken at II—II in FIG. 1, of a detector according to a second specific embodiment of the invention.

FIG. 2*b* shows a schematic, partly enlarged, cross sectional view, taken at II—II in FIG. 1, of a detector according to a second specific embodiment of the invention. This embodiment differs from the embodiment according to FIG. 2*a* in that the anode electrodes 4 and 19 are formed by different conductive elements, being spaced by a dielectric, which could be solid or a gas, and that the openings or channels also are formed in the avalanche anode electrode 19. The avalanche amplification anode 19 is connected to the DC power supply 7. In the case the dielectric between the anode electrodes 4 and 19 is solid, it includes openings or channels through the dielectric, the openings or channels essentially corresponding the openings or channels forming the avalanche regions 25. An electric field is created between the anode electrodes 4 and 19. This field could be a drift field, i.e. a weaker field, or an avalanche amplification field, i.e. a very strong electric field. In connection with FIGS. 3 and 4 below different possible arrangements 15 of read-out elements are shown.

Figure 2C:
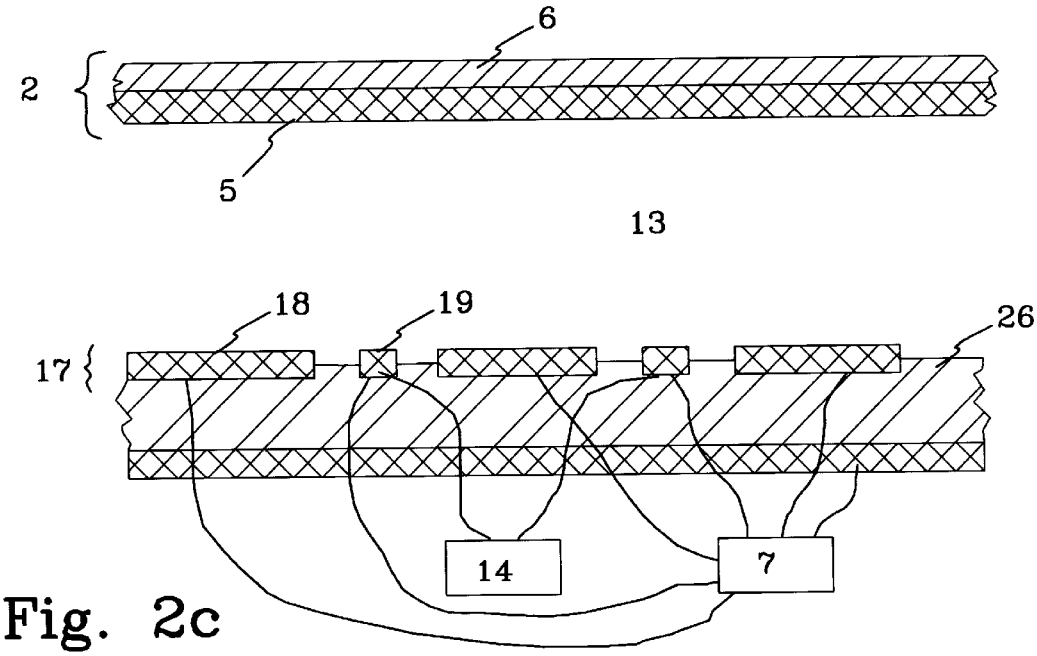
FIG. 2*c* is a schematic, partly enlarged, cross sectional view, taken at II—II in FIG. 1, of a detector according to a third specific embodiment of the invention.

FIG. 2*c* shows a schematic, partly enlarged, cross sectional view, taken at II—II in FIG. 1, of a detector according to a third specific embodiment of the invention. The detector includes a cathode 2, as described above, an anode 1, and an avalanche amplification unit 17. A gap 13 termed a conversion and drift volume is provided between the cathode 2 and the avalanche amplification unit 17. The gap 13 is gas filled and the cathode 2 is formed as described above. The drift anode 1 is provided on a back surface of a dielectric substrate 26, e.g. a glass substrate. On the front surface of the substrate 26, avalanche amplification cathode 18 and anode 19 strips are alternately provided. The cathode 18 and anode 19 strips are conductive strips, and are connected to the DC power supply 7, for creation of a concentrated electric field, i.e. an avalanche amplification field in each region between a cathode strip 18 and an anode 19 strip. The anode 1 and cathode 2 are also connected to the DC power supply 7. The voltages applied are selected so that a weaker electric field, drift field, is created over the gap 13. Alternatively the dielectric substrate 26 can be replaced by a gas. FIG. 2*a* illustrates that the avalanche amplification cathode 18, the avalanche amplification anode 19, and the dielectric 24 are supported by anode plate 1. In an arrangement such as the one shown in FIG. 2*b*, it may be necessary to provide supports for the avalanche amplification cathode 18, the avalanche amplification anode 19, and the dielectric 24, in order to maintain the space between the avalanche amplification anode 19 and the cathode 1. Such supports may be any type of structure known to one of ordinary skill in the art, such as brackets, pedestals, or any other variation, which would maintain the space between the avalanche amplification anode 19 and the anode plate 1.

Preferably the avalanche anode strips 19 also forms the read out elements 20, and are then connected to the processing electronics 14. The avalanche cathode strips 18 could instead form the read out elements, or together with the anode strips 19. As an alternative the anode electrode 1 can be constituted of strips, which can be segmented and insulated from each other. Those strips could then form the read out elements alone or together with the anode and/or cathode strips. The strips acting as anode/cathode and read out element are connected to the DC power supply 7 and the processing electronics 14, with appropriate couplings for separation. In a further alternative the cathode strips 18 and/or the anode strips 19 are formed by an underlying conductive layer covered by a resistive top layer, made of e.g. silicon monoxide, conductive glass or diamond. This reduces the power of possible sparks, which could appear in the gas due to the strong electric field. In a further alternative of an arrangement of read out strips the read out strips 20 are arranged under and parallel with the avalanche anode strips 19. The read out strips 20 are then made a little wider than the avalanche anode strips 19. If they are located under the anode 1 it is necessary that the anode electrode is semi-transparent to induced pulses, e.g. in the form of strips or pads. In yet another alternative the anode 1 can be omitted since the necessary electric fields can be created by means of the cathode electrodes 5, 18 and the anode electrodes 19.

As an example, the glass substrate is about 0.1–5 mm thick. Further, the conductive cathode strip has a width of about 20–1000 $\mu$m and the conductive anode strip has a width of about 10–200 $\mu$m, with a pitch of about 50–2000 $\mu$m. Cathodes and anodes can be divided into segments along their extension.

In operation, X-ray photons enter the space 13 in the detector of FIG. 2*c* essentially parallel with the avalanche cathode 18 and anode 19 strips. In the conversion and drift volume 13 the incident X-ray photons are absorbed and electron-ion pairs are produced as described above. A cloud of primary and secondary electrons, being the result of interactions caused by one X-ray photon drift towards the avalanche amplification unit 17. The electrons will enter the very strong electric field in the gas filled region between an anode strip and a cathode strip, which is an avalanche amplification region. In the strong electric field the electrons initiate electron avalanches. As a result the number of electrons which is collected on the anode strips is of a few orders of magnitude higher than the number of primary and secondary electrons (so called gas multiplication). One advantage with this embodiment is that each electron avalanche only induces a signal mostly on one anode element or essentially on one detector electrode element. The position resolution in one coordinate is therefore determined by the pitch.

Figure 2D:
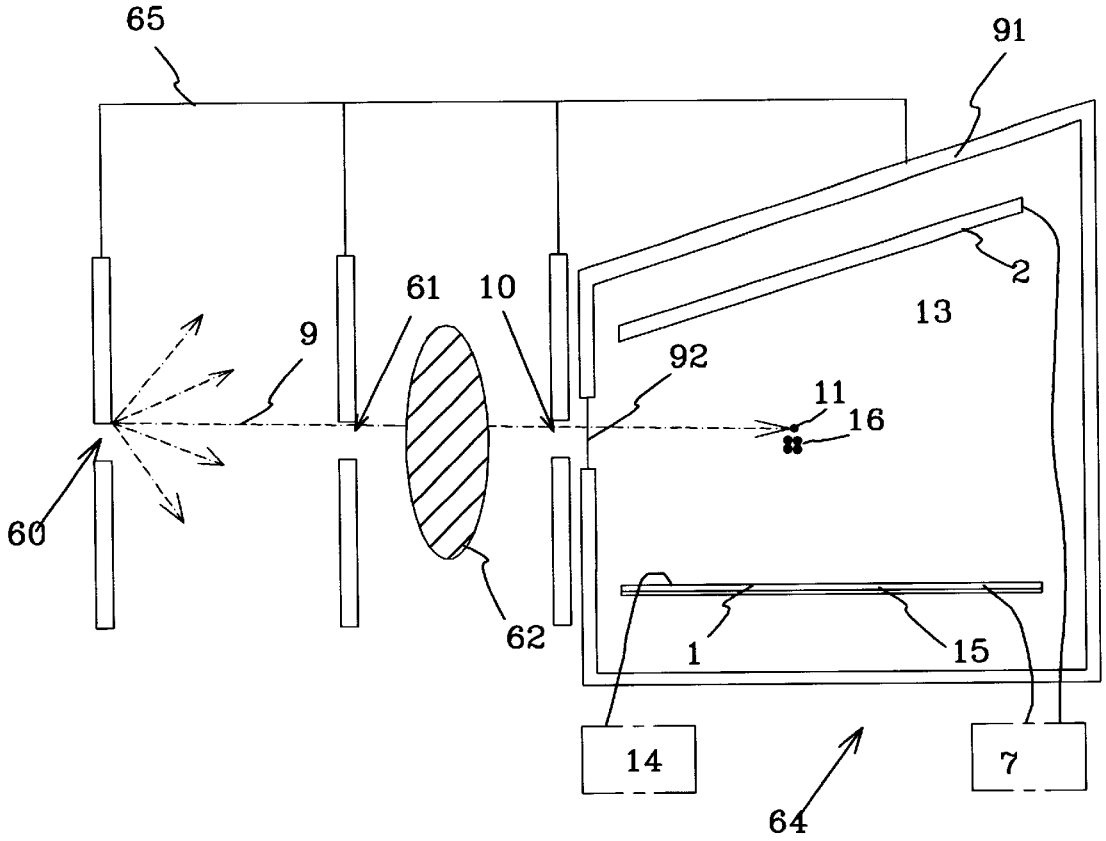
FIG. 2*d* illustrates schematically, in an overall view, an apparatus for planar beam radiography, including a detector according to a fourth specific embodiment of the invention.

FIG. 2*d* shows a schematic, sectional view similar to that of FIG. 1, of a detector according to a fourth specific embodiment of the invention. A voltage is applied between the cathode 2 and the anode 1 for creation of a very strong electric field for avalanche amplification in the gap 13. The gap 13 will form a conversion and avalanche amplification volume. The electric field in the volume will be weaker in the direction of the incident X-ray photons, since the distance between the anode and the cathode increases in that direction. Therefore, the amplification will vary with the distance from the radiation entrance of the detector if one voltage is applied between the cathode 2 and the anode 1. To overcome this the anode 1 and/or cathode 2 can be formed by strips electrically insulated from each other and extending in a direction perpendicular to the direction of the incident radiation. Different voltages are then applied between opposite strips or between strips and opposite electrode, where the applied voltage is increased in the direction of the incoming radiation,thereby creating a uniform electric field.

Figure 2E:
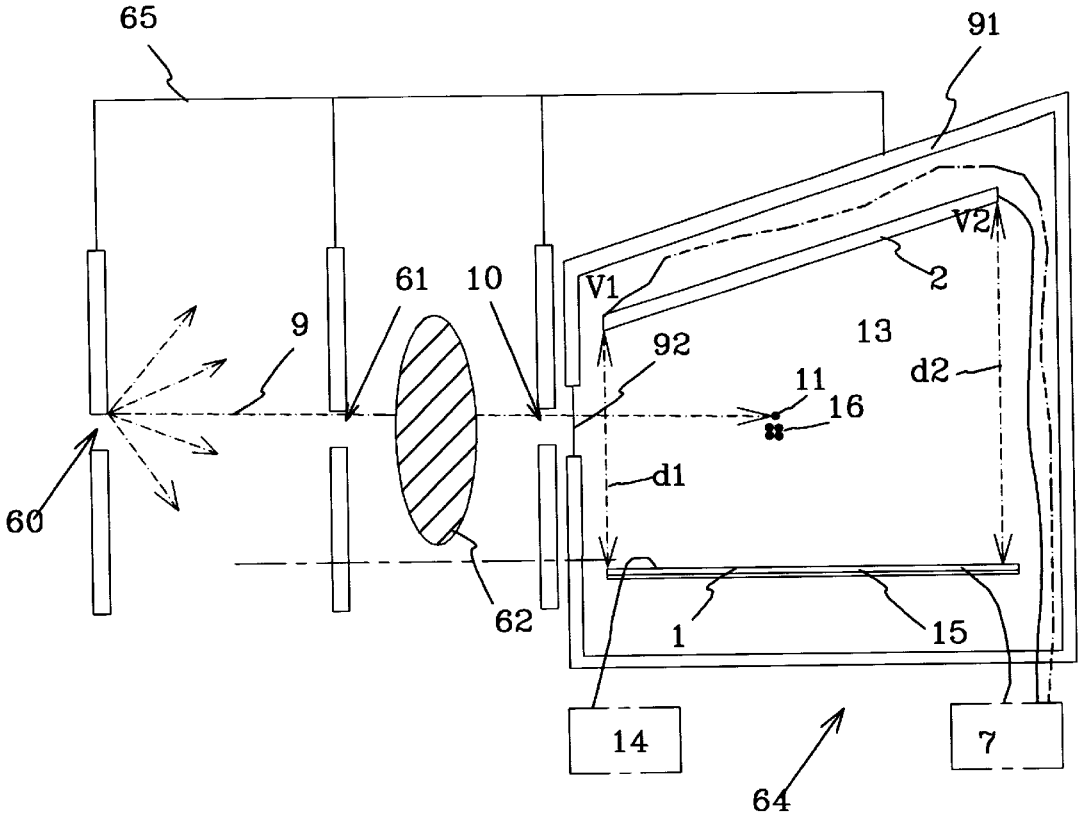
FIG. 2*e* illustrates schematically, in an overall view, an apparatus for planar beam radiography, including a detector according to a fifth specific embodiment of the invention.

In operation, X-ray photons enter the space 13 in the detector of FIG. 2*e* essentially parallel with the anode 1 and close to the cathode 2. In the volume 13 the incident X-ray photons are absorbed and electron-ion pairs are produced as described above. A cloud of primary and secondary electrons, being the result of interactions caused by one X-ray photon is produced. The strong electric field in the volume 13 will cause the electrons initiate electron avalanches. Since the photons travel parallel with the anode 1 and the electric field is uniform the avalanche amplification will be uniform in the detector. Readout elements are arranged separately in connection with and insulated from the drift and avalanche anode 1 or included in the drift and avalanche anode or cathode electrodes, as described in the other embodiments.

An alternative how to achieve a uniform electric field is shown in FIG. 2*e*, which illustrates schematically, in an overall view, an apparatus for planar beam radiography, including a detector according to a fifth specific embodiment of the invention. Here the cathode 2 is made of a resistive material in contact with the volume 13, possibly with a supporting dielectric substrate on the back side. A voltage $V_1$ is applied between the anode 1 and the edge of the cathode 2 closest to the radiation entrance, and a voltage $V_2$ is applied between the anode 1 and the edge of the cathode 2 farthest away from the radiation entrance. If $$\frac{V_1}{d_1} = \frac{V_2}{d_2}$$

when the distance between the anode 1 and the cathode 2 where the voltage $V_1$ is applied is $d_1$, and the distance between the anode 1 and the cathode 2 where the voltage $V_2$ is applied is $d_2$, a uniform electric field will be created between the anode 1 and cathode 2, since the voltage will be distributed over the resistive cathode 2. The other parts of the detector and its operation are the same or similar to what is described above.

As an alternative to create a uniform electric field, a non-uniform field can be created between continuous anode 1 and cathode 2 electrodes. To compensate for differences in amplification an additional set of detector elements in the form of mutually electrically insulated conductive strips extending perpendicular to the direction of the incoming radiation can be provided. Signals from these detector elements are used to compensate for the non-uniform amplification of the signals detected in detector electrode elements formed by mutually electrically insulated conductive strips extending in the direction of the incoming radiation. This compensation is made in the read out electronics 14.

In the embodiments described above different locations for the detector electrode arrangements have been described. There are many variations, e.g. more than one detector electrode arrangement can be provided, adjacent to each other with different directions of the strips or segments, or at separate locations.

Figure 3:
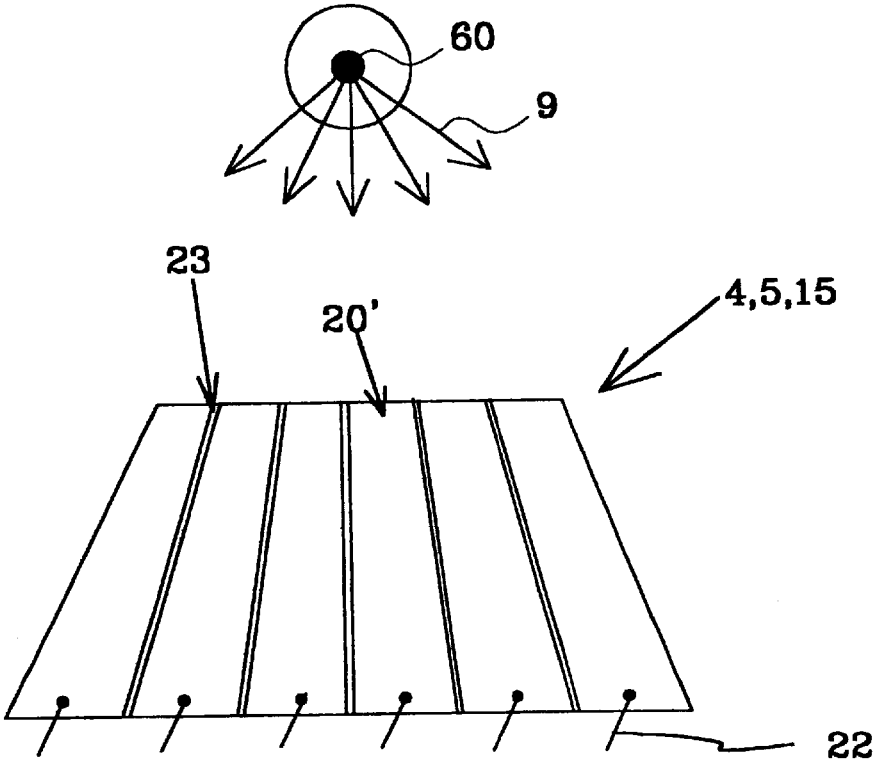
FIG. 3 is a schematic view of an embodiment of an X-ray source and an electrode formed by readout strips.

Referring to FIG. 3, a possible configuration of a detector electrode arrangement 4, 5, 15, is shown. The electrode arrangement 4, 5, 15 is formed by strips 20', and can also act as anode or cathode electrode as well as detector electrode. A number of strips 20' are placed side by side, and extend in directions parallel to the direction of an incident X-ray photon at each location. The strips are formed on a substrate, electrically insulated from each other, by leaving a space 23 between them. The strips may be formed by photolithographic methods or electroforming, etc. The space 23 and the width of the strips 20' are adjusted to the specific detector in order to obtain the desired (optimal) resolution. In for example the embodiment of FIG. 2*a* the strips 20' should be placed under the openings or channels or rows of openings or channels and have essentially the same width as the openings or channels, or somewhat wider. This is valid for both the case that the detector electrode arrangement is located separated from the anode electrode 4 and for the case the detector electrode arrangement also constitutes the anode electrode 4.

Each strip 20' is connected to the processing electronics 14 by means of a separate signal conductor 22, where the signals from each strip preferably are processed separately. Where an anode or cathode electrode constitutes the detector electrode, the signal conductors 22 also connects the respective strip to the high voltage DC power supply 7, with appropriate couplings for separation.

As seen from the figure, the strips 20' and the spacings 23 aim at the X-ray source 60, and the strips grow broader along the direction of incoming X-ray photons. This configuration provides compensation for parallax errors.

The electrode arrangement shown in FIG. 3 is preferably the anode, but alternatively or conjointly the cathode can have the described construction. In the case the detector electrode arrangement 15 is a separate arrangement, the anode electrode 4 can be formed as a unitary electrode without strips and spacings. The same is valid for the cathode electrode or the anode electrode, respectively, when only the other thereof comprises the detector electrode arrangement. However, if the detector electrode arrangement is located on a substrate on the opposite side to a cathode or anode electrode, the anode or cathode electrode should be semi-transparent to induced pulses, e.g. formed as strips or pads.

Figure 4:
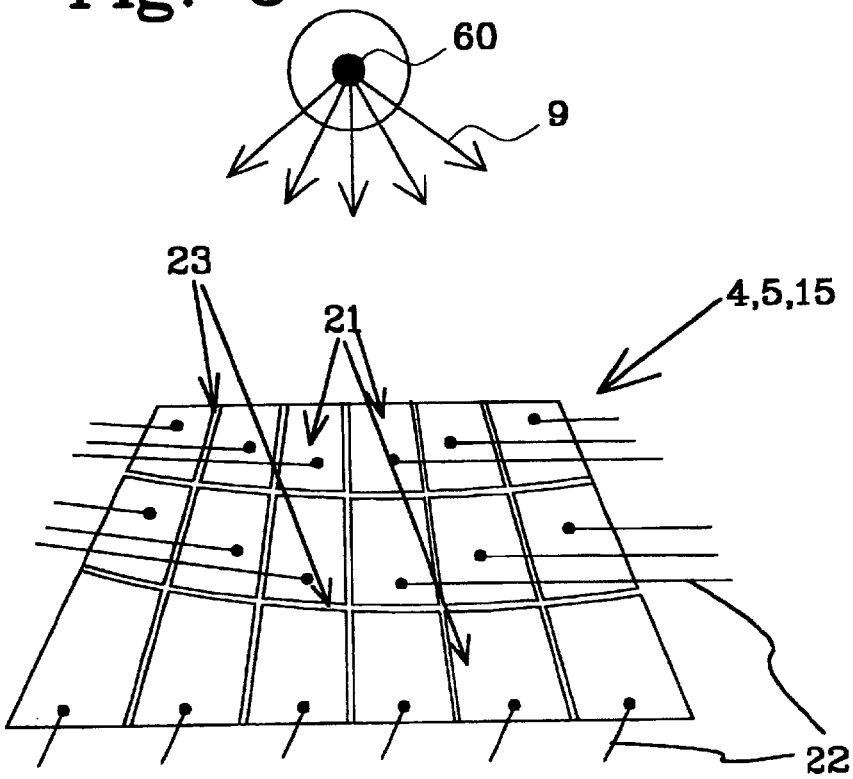
FIG. 4 is a schematic top view of a second embodiment of an X-ray source and an electrode formed by segmented readout strips.

In FIG. 4, an alternative configuration of an electrode is shown. The strips have been divided into segments 21, electrically insulated from each other. Preferably a small spacing extending perpendicular to the incident X-rays is provided between each segment 21 of respective strip. Each segment is connected to the processing electronics 14 by means of a separate signal conductor 22, where the signals from each segment preferably are processed separately. As in FIG. 3, where the anode or cathode electrode constitute the detector electrode, the signal conductors 22 also connects the respective strip to the high voltage DC power supply 7.

This electrode can be used when the energy of each X-ray photon is to be measured, since an X-ray photon having higher energy statistically causes a primary ionization after a longer path through the gas than an X-ray photon of lower energy. By means of this electrode, both the position of X-ray photon interaction and the energy of each X-ray photon can be detected. By statistical methods one can restore the spectrum of the incident photons with very high energy resolution. See for example E. L. Kosarev et al., Nucl. Instr and methods 208 (1983)637 and G. F. Karabadjak et al., Nucl. Instr and methods 217 (1983)56.

Generally for all embodiments, each incident X-ray photon causes one induced pulse in one (or more) detector electrode element. The pulses are processed in the processing electronics, which eventually shapes the pulses, and integrates or counts the pulses from each strip (pad or sets of pads) representing one pixel. The pulses can also be processed so as to provide an energy measure for each pixel.

Where the detector electrode is on the cathode side the area of an induced signal is broader (in a direction perpendicular to the direction of incidence of the X-ray photons) than on the anode side. Therefore, weighting of the signals in the processing electronics is preferable.

Figure 5:
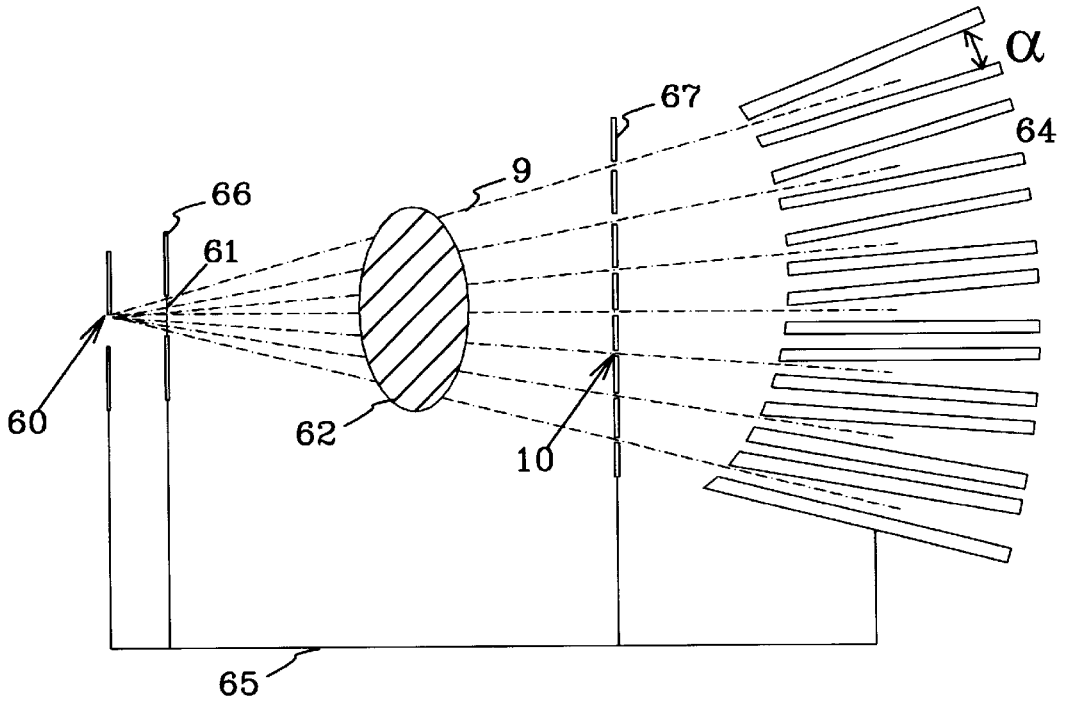
FIG. 5 is a schematic cross sectional view of an embodiment according to the invention, with stacked detectors.

FIG. 5 shows schematically an embodiment of the invention with a plurality of the inventive detectors 64 stacked, one on top of another. By this embodiment a multiline scan can be achieved, which reduces the overall scanning distance, as well as the scanning time. The apparatus of this embodiment includes an X-ray source 60, which together with a number of collimator windows 61 produce a number of planar fan-shaped X-ray beams 9, for irradiation of the object 62 to be imaged. The beams transmitted through the object 62 optionally enter the individual stacked detectors 64 through a number of second collimator windows 10, which are aligned with the X-ray beams. The first collimator windows 61 are arranged in a first rigid structure 66, and the optional second collimator windows 10 are arranged in a second rigid structure 67 attached to the detectors 64, or arranged separately on the detectors.

By choosing the angle $\alpha$ between the anode plate 1 and the cathode plate 2 of each detector, the detectors can be stacked with the surfaces of the detectors facing each other being parallel, when the detectors are aligned with the X-ray source. This facilitates the manufacturing of the multiline detector, since no special steps for aligning and adjustment is needed. The stability of the detector is also increased, while the number of parts is reduced. Preferably the stacked detectors are accommodated in one common housing 91. It can be advantageous if the cathodes 2 of two adjacent detectors face each other, and that the anodes 1 of two adjacent detectors face each other. In such a case the cathodes and/or anodes of two adjacent detectors can be formed into common elements for two adjacent detectors. If they are accommodated in separate housings also the outer walls of each housing exhibit an angle $\alpha$ (i.e. one wall is parallel with the anode plate 1 and one wall is parallel with the cathode plate 2).

Said angle $\alpha$ is in the range of $0<\alpha\leqq 90$, preferably $1/160°$–$6°$.

The X-ray source 60, the rigid structure 66, and the possible structure 67 including collimator windows 61, 10, respectively, and the stacked detectors 64, which are fixed to each other, are connected and fixed in relation to each other by for example a frame or support 65. The so formed apparatus for radiography can be moved as a unit to scan an object, which is to be examined. In this multiline configuration, the scanning can be done in a transverse movement, perpendicular to the X-ray beam, as mentioned above. It can also be advantageous if the apparatus for radiography is fixed and the object to be imaged is moved.

A further advantage of using a stacked configuration, compared to large single volume gas detectors, is reduction of background noise caused by X-ray photons scattered in the object 62. These scattered X-ray photons travelling in directions not parallel to the incident X-ray beam could cause "false" signals or avalanches in one of the other detectors 64 in the stack, if passing through anode and cathode plates and entering such a chamber. This reduction is achieved by significant absorption of (scattered) X-ray photons in the material of the anode and the cathode plates, or the collimator 67.

Figure 6:
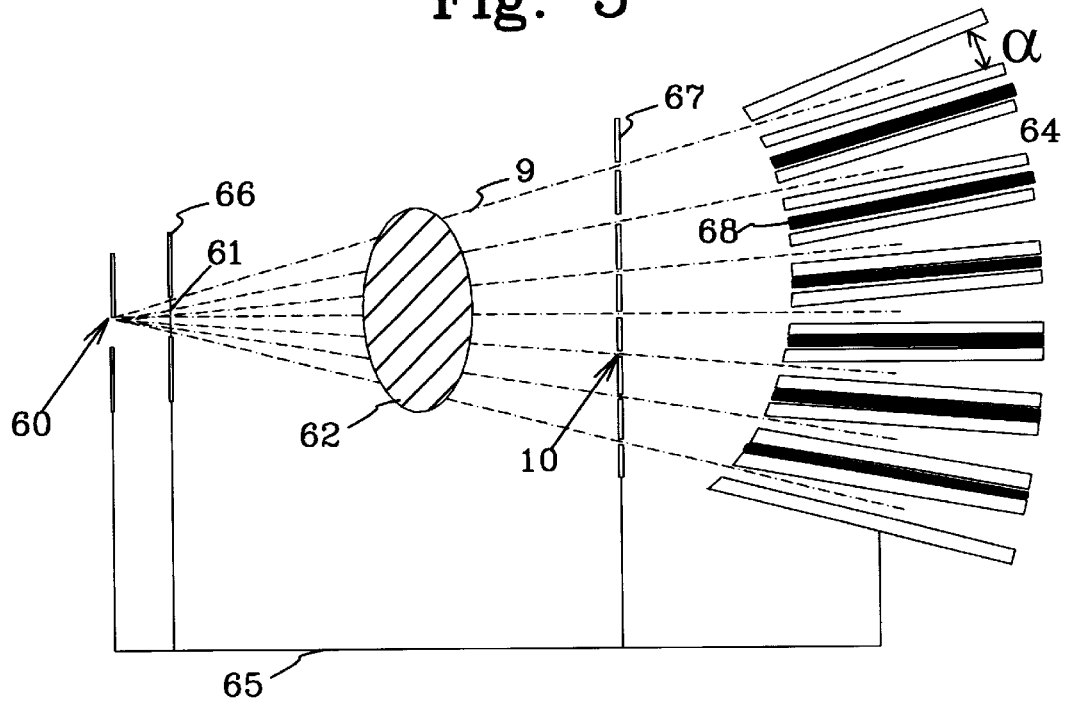
FIG. 6 is a schematic cross sectional view of a further embodiment according to the invention, with stacked detectors.

This background noise can be further reduced by providing thin absorber plates 68 between the stacked detectors 64, as shown in FIG. 6. The stacked detector is similar to that of FIG. 5, with the difference that thin sheets of absorbing material is placed between each adjacent detectors 64. These absorber plates or sheets can be made of a high atomic number material, for example tungsten.

In all embodiments the gas volumes are very thin, which results in a fast removal of ions, which leads to low or no accumulation of space charges. This makes operation at high rate possible.

In all embodiments the small distances leads to low operating voltages, which results in low energy in possible sparks, which is favorable for the electronics.

The focusing of the field lines in the embodiments is also favorable for suppressing streamer formations. A streamer is a form of channel of plasma in which a spark can form. This leads to a reduced risk for sparks.

As an alternative for all embodiments, the electric field in the conversion and drift gap (volume) can be kept high enough to cause electron avalanches, hence to be used in a preamplification mode.

Although the invention has been described in conjunction with a number of preferred embodiments, it is to be understood that various modifications may still be made without departing from the spirit and scope of the invention, as defined by the appended claims. For example the voltages can be applied in other ways as long as the described electrical fields are created.

What is claimed is:

1. A detector for detection of ionizing radiation, comprising:

a chamber filled with an ionizable gas, first and second electrode arrangements provided in said chamber with a space between them, said space including a conversion volume, and an electron avalanche amplification unit arranged in said chamber, and wherein the first and second electrode arrangements exhibit a first and a second main plane, said planes being non-parallel, said electron avalanche amplification unit including at least one avalanche cathode arrangement and at least one avalanche anode arrangement, wherein an electric field for avalanche amplification is created between said at least one avalanche cathode arrangement and said at least one avalanche anode arrangement.

2. The detector according to claim 1, wherein it further comprises at least one arrangement of read-out elements for detection of elements for detection of electron avalanches, and where a radiation entrance is provided so that radiation enters the conversion volume between the first and second electrode arrangements.

3. The detector according to claim 1, wherein, an essentially uniform electric field is provided between the avalanche cathode arrangement and the avalanche anode arrangement.

4. The detector according to claim 1, wherein, the first electrode arrangement is a first cathode arrangement, the second electrode arrangement is a first anode arrangement, the first cathode arrangement is constituted by an avalanche cathode arrangement and the first anode arrangement is constituted by an avalanche anode arrangement, at least one of the avalanche cathode arrangement and the avalanche anode arrangement being divided into a plurality of electrode elements electrically insulated in relation to each other, and between each avalanche cathode element and avalanche anode element a voltage is to be applied for creation of an essentially uniform electric field between the avalanche cathode arrangement and the avalanche anode arrangement.

5. The detector according to claim 1, wherein, the first electrode arrangement is a first cathode arrangement, the second electrode arrangement is a first anode arrangement, an avalanche cathode arrangement in the form of a conductive mesh is arranged parallel with the first anode arrangement, a first voltage is to be applied between the first cathode arrangement and the second anode arrangement and a second voltage is to be applied between the avalanche cathode arrangement and the avalanche anode arrangement for creation of a first electric field between the first cathode arrangement and the avalanche cathode arrangement and a plurality of regions with concentrated electric fields in the electron avalanche amplification unit, where the concentrated electric fields are stronger than the first electric field.

6. The detector according to claim 5, wherein, the second anode arrangement is constituted by the avalanche anode arrangement.

7. The detector according to claim 1, wherein said electron avalanche amplification unit includes a plurality of avalanche regions.

8. The detector according to claim 1, wherein said at least one avalanche cathode and said at least one avalanche anode are formed on a first side of a dielectric substrate with a separation between said at least one avalanche cathode and said at least one avalanche anode, said separation forming said limiting surface.

9. The detector according claim 8, wherein said at least one avalanche cathode and said at least one avalanche anode include electrically conductive strips.

10. The detector according to claim 8, wherein a plurality of avalanche cathodes and anodes are alternatingly provided on said substrate.

11. The detector according to claim 10, wherein said avalanche cathodes and said avalanche anodes include electrically conductive strips having longitudinal edges essentially parallel with the incident radiation.

12. The detector according to claim 1, wherein a plurality of avalanche regions are arranged between said at least one avalanche cathode and said at least one avalanche anode.

13. The detector according to claim 1, wherein said at least one avalanche cathode are formed on a first side of a dielectric substrate and said at least one avalanche anode are formed on a second side of said dielectric substrate, at least one channel being arranged in said at least one avalanche cathode and said dielectric substrate, and said at least one avalanche anode forming a wall of said at least one channel.

14. The detector according to claim 1, wherein said at least one avalanche cathode are formed on a first side of a dielectric substrate and said at least one avalanche anode are formed on a second side of said dielectric substrate, at least one channel being arranged in said at least one avalanche cathode, said dielectric substrate, and said at least one avalanche anode.

15. The detector according to claim 13, wherein, said at least one channel has an essentially circular cross section.

16. The detector according to claim 13, wherein, said at least one channel has an essentially quadratic cross section and extends between two opposing edges of the dielectric substrate.

17. The detector according to claim 1, wherein, the read-out elements include elongated strips having longitudinal edges parallel with the incident radiation.

18. The detector according to claim 1, wherein, the read-out elements include elongated strips having longitudinal edges perpendicular to the incident radiation.

19. The detector according to claim 1, wherein, the first electrode arrangement is a drift cathode, the second electrode arrangement is a drift anode, and the read-out elements are arranged between the drift anode and the avalanche anode.

20. The detector according to claim 1, wherein, the first electrode arrangement is a drift cathode, the second electrode arrangement is a drift anode, the drift anode is arranged between the read-out elements and the avalanche anode.

21. The detector according to claim 1, wherein, the first electrode arrangement is a drift cathode, the second electrode arrangement is a drift anode, the drift cathode is arranged between the read-out elements and the avalanche cathode.

22. The detector according to claim 1, wherein, the read-out elements also constitute the first drift electrode arrangement.

23. The detector according to claim 1, wherein, the read-out elements constitute the second drift electrode arrangement.

24. The detector according to claim 1, wherein, the read-out elements constitute the avalanche anode arrangement.

25. The detector according to claim 1, wherein a thin slit or collimator window is arranged with the radiation entrance so that radiation will be incident close to the first drift electrode arrangement.

26. The detector according to claim 1, wherein a thin slit or collimator window is arranged with the radiation entrance so that radiation will be incident close to the avalanche cathode arrangement.

27. An apparatus for use in planar beam radiography, comprising:

an X-ray source, a substantially planar beam unit for forming a substantially planar X-ray beam positioned between said X-ray source and an object to be imaged, a chamber filled with an ionizable gas, first and second electrode arrangements provided in said chamber with a space between them, said space including a conversion volume, and an electron avalanche amplification unit arranged in said chamber, and wherein the first and second electrode arrangements exhibit a first and a second main plane, said planes being non-parallel, said electron avalanche amplification unit including at least one avalanche cathode arrangement and at least one avalanche anode arrangement, wherein an electric field for avalanche amplification is created between said at least one avalanche cathode arrangement and said at least one avalanche anode arrangement.

28. The apparatus according to claim 27, wherein a number of said detectors are stacked to form a detector unit, wherein a substantially planar beam unit for forming an essentially planar X-ray beam is arranged for each detector, said substantially planar beam units being positioned between said X-ray source and the object to be imaged, wherein the X-ray source, said substantially planar beam units and said detector unit are fixed in relation to each other in order to form said apparatus, which can be used for scanning the object.

29. The apparatus according to claim 28, wherein absorber plates are arranged between the detectors in order to absorb scattered X-ray photons.

30. The apparatus according to claim 27, wherein a thin slit or collimator window is arranged on the side of each detector that faces the X-ray source.

* * * * *